US008608031B2

(12) United States Patent
Lasserre et al.

(10) Patent No.: US 8,608,031 B2
(45) Date of Patent: Dec. 17, 2013

(54) LOCKABLE DISPENSING HEAD

(75) Inventors: Pierre-Andre Lasserre, Coubron (FR); Marcel Sanchez, Paris (FR); Pedro Pares Montaner, Esplugues de LL. (ES)

(73) Assignee: L'Oreal, Paris (FR)

( * ) Notice: Subject to any disclaimer, the term of this patent is extended or adjusted under 35 U.S.C. 154(b) by 1222 days.

(21) Appl. No.: 11/674,301

(22) Filed: Feb. 13, 2007

(65) Prior Publication Data

US 2007/0119870 A1 May 31, 2007

Related U.S. Application Data

(63) Continuation of application No. 11/028,532, filed on Jan. 5, 2005.

(60) Provisional application No. 60/536,226, filed on Jan. 14, 2004.

(30) Foreign Application Priority Data

Jan. 5, 2004 (FR) ..... 04 50007

(51) Int. Cl.
*B67B 1/00* (2006.01)

(52) U.S. Cl.
USPC ..... 222/153.13; 222/321.8; 222/383.1

(58) Field of Classification Search
USPC ..... 222/321.8, 383.1, 321.1, 153.11, 222/153.13, 182, 183
See application file for complete search history.

(56) References Cited

U.S. PATENT DOCUMENTS

| | | | | |
|---|---|---|---|---|
| 2,706,660 | A | 4/1955 | Johnson et al. | |
| 2,781,950 | A | 2/1957 | Pritchard | |
| 3,062,411 | A | 11/1962 | Miles et al. | |
| 3,249,260 | A | 5/1966 | Goldberg | |
| 3,252,626 | A * | 5/1966 | Belka | 222/402.11 |

(Continued)

FOREIGN PATENT DOCUMENTS

| | | |
|---|---|---|
| EP | 1 317 963 | 6/2003 |
| EP | 1 317 963 A1 | 6/2003 |

(Continued)

OTHER PUBLICATIONS

Interrogatory & Preliminary Examination Report (English Translation), Date Prepared: Aug. 19, 2009, Date Issued: Sep. 8, 2009.

*Primary Examiner* — Kevin P Shaver
*Assistant Examiner* — Melvin Cartagena
(74) *Attorney, Agent, or Firm* — Oblon, Spivak, McClelland, Maier & Neustadt, L.L.P.

(57) ABSTRACT

A dispensing head which can be mounted on a receptacle. The dispensing head includes a pump, for surmounting the receptacle, with an actuating rod having a longitudinal axis X. A diffuser is mounted on the pump, and includes a tube opening at a dispensing orifice, with the tube being elongated along an axis Y distinct from the axis X. A lever arm controls the actuation of the pump, with the lever arm including a portion capable of coming to bear on the diffuser in order to actuate the pump. In addition, a locking member is configured such that, in a first position, the locking member allows actuation of the pump and, in a second position, the locking member prevents actuation of the pump. In a disclosed example, in the second position the tube abuts against a portion of the locking member to prevent actuation of the pump.

20 Claims, 3 Drawing Sheets

(56) References Cited

U.S. PATENT DOCUMENTS

| | | | | | |
|---|---|---|---|---|---|
| 3,422,996 | A | * | 1/1969 | Lipman | 222/402.11 |
| 3,426,948 | A | | 2/1969 | Stirling | |
| 3,429,310 | A | | 2/1969 | Jaffe et al. | |
| 3,474,939 | A | | 10/1969 | O'Donnell et al. | |
| 3,590,691 | A | | 7/1971 | Magers et al. | |
| 3,608,791 | A | | 9/1971 | Jordan et al. | |
| 3,726,442 | A | | 4/1973 | Davidson et al. | |
| 3,749,286 | A | | 7/1973 | Douglas et al. | |
| 3,904,088 | A | | 9/1975 | Milbourne, Sr. | |
| 4,024,988 | A | * | 5/1977 | Starrett | 222/153.11 |
| 4,077,548 | A | * | 3/1978 | Beard | 222/321.8 |
| 4,077,549 | A | * | 3/1978 | Beard | 222/321.8 |
| 4,373,644 | A | | 2/1983 | Bennett | |
| 4,441,633 | A | | 4/1984 | Bennett | |
| 4,848,595 | A | | 7/1989 | Foster et al. | |
| 4,889,262 | A | * | 12/1989 | Toms | 222/153.13 |
| 4,972,974 | A | | 11/1990 | Chavkin et al. | |
| 4,991,746 | A | | 2/1991 | Schultz et al. | |
| 5,070,611 | A | | 12/1991 | Derin et al. | |
| 5,379,924 | A | | 1/1995 | Taylor | |
| 5,388,730 | A | | 2/1995 | Abbott et al. | |
| 5,458,263 | A | | 10/1995 | Ciammitti et al. | |
| 5,772,080 | A | * | 6/1998 | de Pous et al. | 222/321.7 |
| 5,899,363 | A | | 5/1999 | Bliss, III | |
| 5,971,230 | A | | 10/1999 | Tanaka | |
| 5,992,707 | A | | 11/1999 | Gaichuk | |
| 6,186,364 | B1 | | 2/2001 | Dobbs | |
| 6,247,613 | B1 | | 6/2001 | Meshberg | |
| 6,932,244 | B2 | | 8/2005 | Meshberg | |
| D525,123 | S | * | 7/2006 | Walters et al. | D9/448 |
| 7,249,692 | B2 | * | 7/2007 | Walters et al. | 222/153.11 |
| 2003/0127466 | A1 | | 7/2003 | Loghman-Adham et al. | |
| 2006/0006198 | A1 | * | 1/2006 | Lasserre et al. | 222/383.1 |
| 2012/0018456 | A1 | * | 1/2012 | Alluigi | 222/321.8 |

FOREIGN PATENT DOCUMENTS

| | | | | | |
|---|---|---|---|---|---|
| EP | 1661822 | A1 | * | 5/2006 | B65D 83/16 |
| FR | 2 398 196 | | | 2/1979 | |
| FR | 2 659 630 | | | 9/1991 | |
| GB | 2 238 088 | | | 5/1991 | |
| JP | 48-20809 | | | 3/1973 | |
| JP | 62-202362 | | | 12/1987 | |
| JP | 63-144464 | | | 9/1988 | |
| JP | 5-7359 | | | 2/1993 | |
| JP | 5-51469 | | | 7/1993 | |
| JP | 9-40043 | | | 2/1997 | |
| JP | 09-057161 | | | 3/1997 | |
| JP | 10-099745 | | | 4/1998 | |
| JP | 2000-185755 | | | 7/2000 | |
| JP | 2000-335618 | | | 12/2000 | |
| JP | 2003-230854 | | | 8/2003 | |

* cited by examiner

LOCKABLE DISPENSING HEAD

CROSS REFERENCE TO RELATED APPLICATIONS

This application is a continuation of U.S. patent application Ser. No. 11/028,532, filed Jan. 5, 2005, the disclosure of which is incorporated herein by reference in its entirety. This application claims priority to French Application Number 04 50007, filed Jan. 5, 2004, and U.S. Provisional Patent Application No. 60/536,226, filed Jan. 14, 2004, the disclosures of which are incorporated herein by reference in their entireties.

BACKGROUND

The present invention relates to a dispensing head that can be used in a device for packaging and dispensing a product. The invention can be particularly advantageous for dispensing cosmetic products, particularly products to be dispensed in the form of a cream, a gel, a foam or a spray.

"Cosmetic product" is understood to mean a product as defined in Council Directive 93/35/EEC of 14 Jun. 1993 amending for the sixth time Directive 76/768/EEC.

Generally speaking, a dispensing head can be associated with a packaging and dispensing device that includes a receptacle containing the product to be dispensed, with the receptacle having an open end on which the dispensing member can be mounted. The dispensing member may be a pump or a valve associated with a dispensing head. A dispensing head of this type enables the user to convey the product emerging from the container towards a dispensing orifice. The dispensing head may also make it possible to control the actuation of the dispensing member in order to eject a measure of product out of the receptacle.

Certain applications, for example the spraying of a relatively viscous product, such as milks or oils, require the use of pre-compression pumps in order for it to be possible to form a good-quality spray of fine particles. However, such pumps can be difficult to actuate with a simple push-button. Accordingly, a dispensing head can include a trigger acting as a lever arm for pushing the push-button in order to facilitate actuation.

To prevent accidental actuation of dispensing heads, it is known to use protective caps. However, dispensing heads that include lever arms can be relatively cumbersome and difficult to cover with a cap.

U.S. Pat. Nos. 4,373,644 and 4,441,633 describe, for example, dispensing heads provided with triggers that include a safety device to prevent young children from actuating the trigger. However, the dispensing heads described are of the "trigger" type, i.e. the pump is entirely incorporated into the head provided with the trigger and cannot be separated therefrom. Thus, if it is desired to change the pump in order, for example, to dispense a different measure of product, it is necessary to change the entire dispensing head and to choose a head that includes a pump that makes it possible to deliver the desired measure. Furthermore, such triggers can be unattractive and do not allow a very wide choice of designs.

The safety device described in the above patents is, moreover, impractical in that it consists of an open ring provided in order to be removably mounted on the trigger. The ring can thus easily be separated from the trigger and risks being lost. On the other side of the opening, the ring includes a protrusion provided to abut against the end of the trigger in order to prevent its displacement in the locked position. The protrusion is housed in a groove provided at the rear of the trigger so that, in the locked position, the ring does not rotate. The user then has to raise the trigger the direction opposite from its direction of actuation, and then rotate the ring in order to displace the protrusion and free the trigger to be actuated. Similarly, when the user wishes to prevent any actuation of the head, he or she again has to raise the trigger and cause the ring to rotate until the ring's protrusion is aligned with the trigger, using only a visual reference mark. Such an arrangement can be cumbersome or impractical.

Document EP 1,317,963 describes a dispensing head provided with a trigger that includes a locking member in the form of a ring. The ring surrounds a portion of the diffuser sleeve-fitted on the actuating rod of the pump, with the ring being able to rotate about the portion of the diffuser between a locked position and a use position. The portion of the diffuser extending in the same axis as the actuating rod includes, in its upper part, a protuberance which is able to slide in a groove provided on the inner surface of the ring in the use position and which abuts against the ring in the locked position.

Documents JP-10099745 and JP-09057161 describe other types of locking devices provided on dispensing heads provided with a trigger. The locking devices described in those documents are small bars that in the locked position block the trigger so as to prevent actuation.

SUMMARY

It is one of the objects of the invention to provide a dispensing head that does not have the drawbacks of the prior art.

It is, in particular, an object of the invention to provide a dispensing head that can be used with or fitted to pumps that can vary depending on the product desired to be sprayed and/or the measure of product that is desired to be sprayed.

It is also a further object of the invention to provide a dispensing head that has a desirable appearance, is simple to use and economical to produce.

It is yet a further object of the invention to provide a dispensing head that makes it possible to prevent accidental actuation of a pump that it is intended to control.

It is also an object to provide a dispensing head that makes it possible to spray a relatively viscous product without requiring an excessive amount of force in order to actuate the head, while still obtaining a good-quality spray.

The above and other objects and advantages of the invention will be apparent with reference to examples of disclosed embodiments described herein. It is to be understood however that, in practicing the invention, variations are possible and thus a given arrangement need not include each feature of the examples described herein. Thus, a given arrangement might include only some of the features described herein and/or might achieve only some of or portions of the objectives of the preferred embodiments described herein.

According to a preferred example, the present invention provides a dispensing head that can be associated with a receptacle, with the dispensing head including a pump associated with the receptacle and equipped with an actuating rod having a longitudinal axis X. A diffuser is mounted on the pump, and includes a tube opening out via a dispensing orifice, with the tube being elongated along an axis Y distinct from the axis X. A lever arm is provided for controlling the actuation of the pump, with the lever arm including a portion capable of coming to bear on and push the diffuser to actuate the pump. A ring-shaped locking member is configured in order, in a first position, to allow the actuation of the pump and, in a second position, to prevent the actuation of the pump, with the tube abutting on a portion of the locking member in the second position.

In accordance with a preferred example, the head includes a diffuser mounted directly on a pump and a lever arm for bearing on the diffuser. This arrangement makes it possible to use a standard pump that could, furthermore, be used with the diffuser alone, unlike triggers where the pump is entirely incorporated into the head provided with the trigger. The head arrangement may thus be used with different standard pump models, for example pumps for different measures or amounts, depending on the product it is desired to dispense. In particular, use may be made of pre-compression pumps that make it possible to spray relatively viscous products, such as, for example, oils or milks, to provide good-quality sprays.

Different designs may be used in order to produce a head of this type since it is possible, for example, to choose or modify the shape of the diffuser and/or the lever arm.

According to another advantageous feature of a preferred embodiment, by way of example, the use of a lever arm makes it possible to limit the forces necessary for actuation of the pump and to improve comfort in use.

In addition, the presence of the locking member makes it possible to limit accidental actuation of the pump.

According to a disclosed example, the locking member may be a ring, movable in rotation, surrounding the diffuser at least partially, with the ring including at least one upper edge on which the tube comes to abut in the second position of the ring. The upper edge of the ring may also include a set-back forming a notch that allows the pushing of the diffuser in the first position of the ring. In particular, the tube may be arranged above the ring and vertically aligned with the notch when the ring is in the first position.

The ring may be provided with at least one tab extending radially towards the outside of the ring, and preferably with two diametrically opposed tabs on the ring. The presence of one or two tabs facilitates displacement of the ring in rotation. The tab or tabs may be capable of abutting or engaged in the first position and in the second position. Thus, the two positions are more readily identified to the user, who simply has to displace the ring until it is unable to move any further.

According to another feature of a disclosed embodiment, by way of example, the lever arm may include a window traversed by the tube. It is thus possible to use a relatively long lever arm in order to improve the lever effect and thus further improve ease of use or comfort.

Further, by way of example, the dispensing head may include a mounting band capable of being fastened onto the receptacle, particularly by snap-fitting or screwing. The pump may be fastened onto the mounting band, for example by snap-fitting.

The lever arm may be articulated on the mounting band, for example, by a hinge with a pin. The lever arm may include a first end articulated on the mounting band, with an opposite second end being designed to form a bearing surface for controlling the actuation of the pump.

The invention also relates to a packaging and dispensing device which includes a receptacle surmounted by a dispensing head as described herein, with the receptacle being able to contain a cosmetic product.

The device is particularly useful for packaging and dispensing a cosmetic product, particularly a cosmetic product dispensed in the form of a cream, a foam, a gel or a spray.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
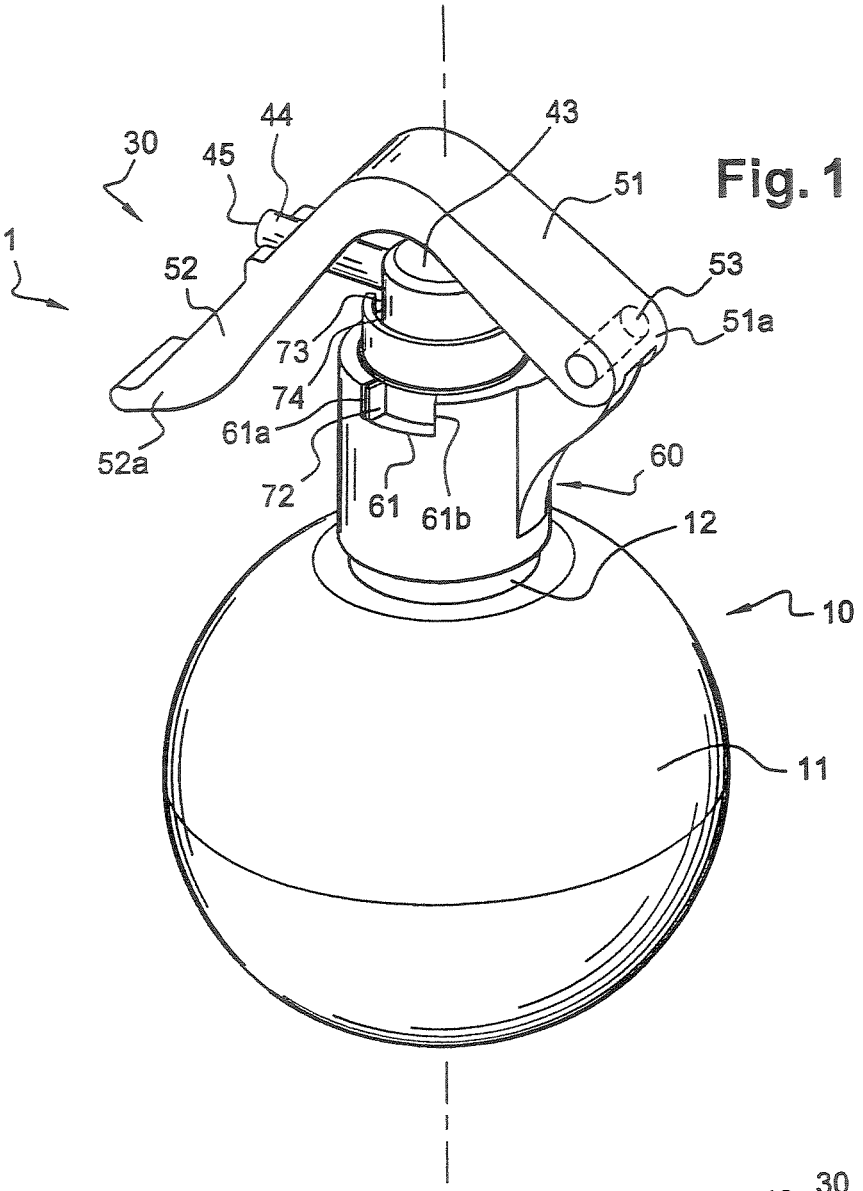
FIG. 1 illustrates a perspective view of a packaging and dispensing device provided with a dispensing head according to the invention.

Referring now to the drawings, wherein like reference numerals designate identical or corresponding parts throughout the several views.

Figure 2:
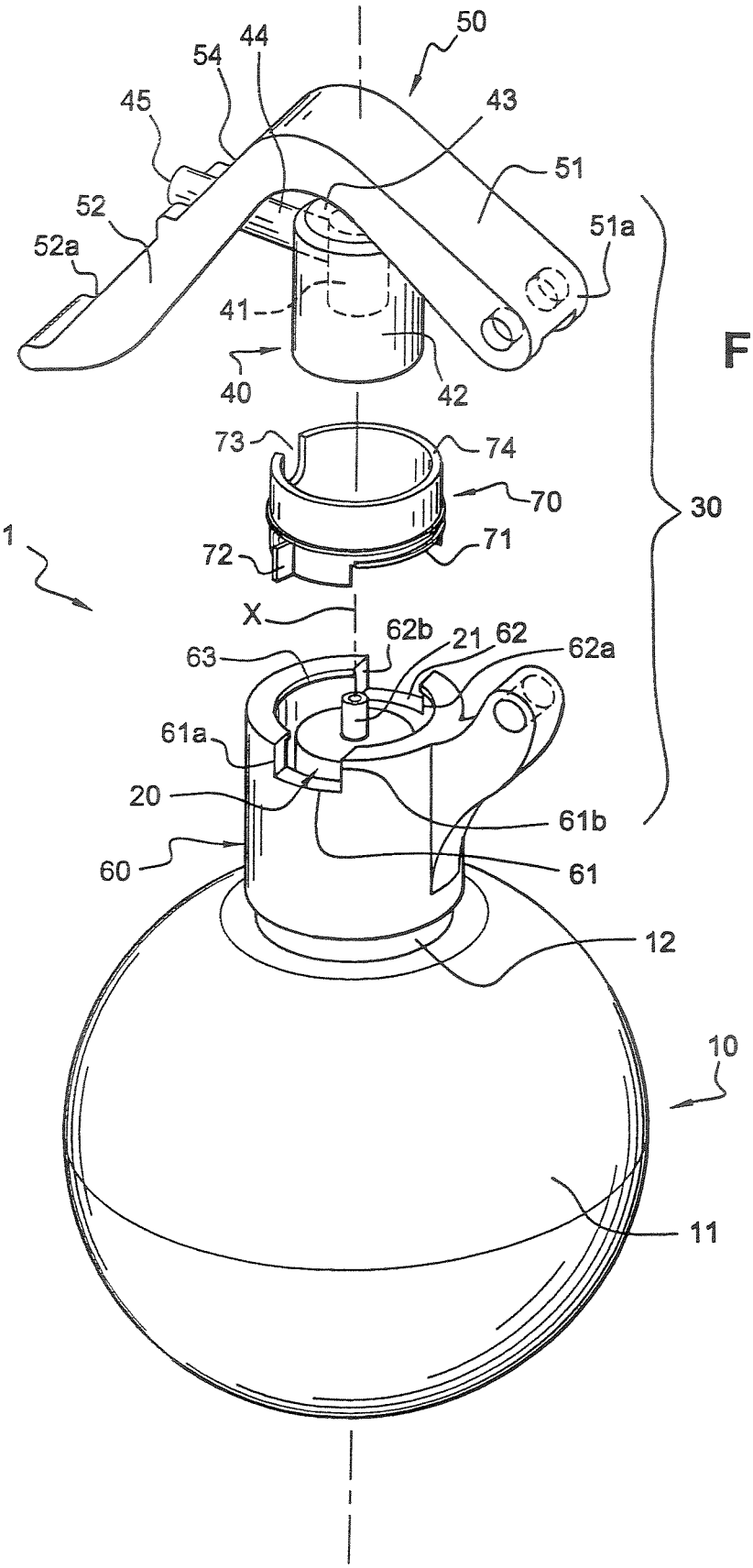
FIG. 2 shows an exploded view of the device illustrated in FIG. 1.

FIGS. 1 and 2 show a packaging and dispensing device 1 equipped with a dispensing head 30 according to an example of the invention.

The device 1 includes a receptacle 10 produced, for example, from thermoplastics. It is to be understood that any other suitable material may be used to produce the receptacle such as tinplate or aluminum. The receptacle 10 includes a body 11 which, in the illustrated example, has a spherical general shape that includes an open neck 12 with an axis X in which a pump 20 is mounted. The receptacle can, alternatively, have any other shape, particularly a cylindrical shape.

The pump 20, which is not shown in detail in the figures but which can be seen partially in FIG. 2, is a standard pump in the illustrated example, preferably a pre-compression pump. The pump in the illustrated example includes a piston whose displacement inside the pump body, in one direction, gives rise to the emergence, under pressure, of the product and, in the other direction, gives rise to the suction of the product into the pump body. Generally, the piston is held in its position corresponding to the maximum volume of the pumping chamber by means of a spring. As may be seen in FIG. 2, the pump includes an actuating rod 21, with longitudinal axis X, that may be displaced axially as pressure is exerted on it in order to actuate the pump.

The pump 20 is surrounded by a mounting band 60 with the pump, for example, snap-fitted inside the mounting band. The band 60 is fastened, for example by means of snap-fitting, onto the inner surface of the receptacle's neck. Alternatively, the band 60 may be screwed onto the receptacle's neck. As may be seen, in particular, in FIG. 2, the upper edge of the band 60 includes two set-backs, which are diametrically opposed, each forming an indentation or recessed portion 61 and 62, the function of which will be explained later in the description. In the illustrated example, each indentation is delimited laterally by two edges 61*a*, 61*b* and 62*a*, 62*b*.

A diffuser 40 is preferably removably mounted on the nozzle 21 of the pump. The diffuser 40 includes a sleeve 41 designed to slip directly over the nozzle and also a skirt 42 that surrounds the sleeve and is closed in its upper part by a transverse wall 43. The diffuser also includes a tube 44 that is elongated along an axis Y extending substantially perpendicularly to the axis of the sleeve, with the tube opening out at a spray orifice 45. The spray orifice is delimited by an attached nozzle head 46 arranged at the end of the tube 44. Thus, the spray orifice communicates selectively with the interior of the pump via a conduit that on the one hand traverses the tube 44 and on the other hand the sleeve 41.

An actuating member 50 in the form of a trigger is provided for controlling the actuation of the pump by pushing the diffuser 40, which in turn pushes the actuating rod 21.

The trigger 50 is formed by a bent lever arm extending on either side of the band 60, passing over the diffuser 40. The lever arm includes a first portion 51, a first end 51*a* of which is mounted pivotably on the band 60 by means of a hinge having a pin 53. The lever arm then extends over the diffuser 40 and redescends on the other side of the band via a second portion 52 that includes a second end 52*a* forming a surface on which the user can bear in order to cause the lever arm to pivot. The lever arm 50 is relatively long in order to optimize the lever effect and thus the comfort or ease of use.

Figure 3:
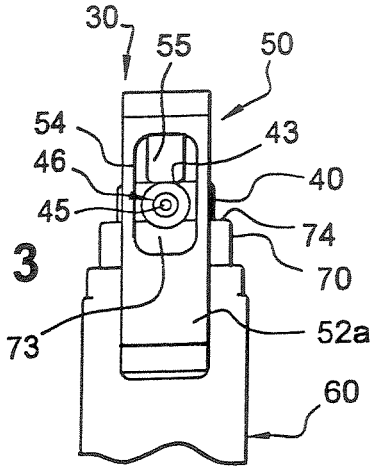
FIGS. 3 and 4 illustrate two different views of the dispensing head according to the invention.
Figure 4:
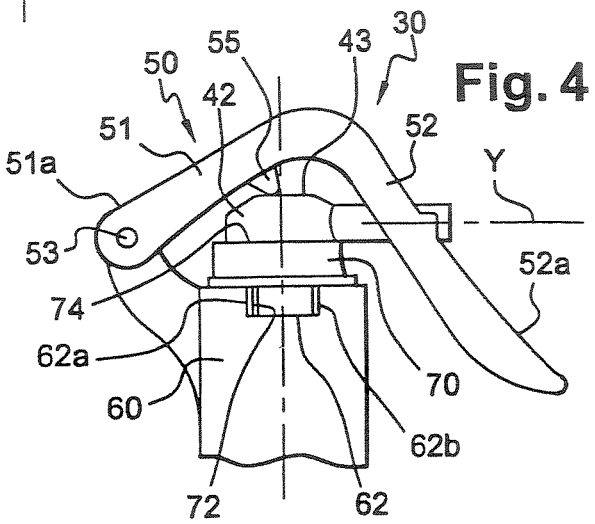

As may be seen in FIG. 4, a stud 55 is provided under the portion 51 of the lever arm in order to come to bear on the transverse wall 43 of the diffuser and allow the actuation of the pump. The second portion 52 of the lever arm is also provided with a window 54 (visible in FIG. 3) that may be traversed by the tube 44. The lever arm may thus extend below the tube.

The dispensing head 30 also includes a locking member 70 designed to prevent accidental actuation of the pump. The locking member 70 in the illustrated example is formed by a cylindrical ring, with the ring being mounted inside the band 60 so that it cannot easily be removed from the head by a user. The ring 70 includes, on its outer surface, a rib 71 designed to be housed in a corresponding groove 63 formed on the inner surface of the band and enabling it to be displaced in rotation inside the band. In the example shown, the rib 71 is formed by two portions of an arc of a circle.

In the illustrated example, the ring 70 surrounds the skirt 42 of the diffuser over a part of its axial height, with the upper edge 74 of the ring being located under the tube 44 in the non-actuated position. The upper edge 74 of the ring includes a set-back forming a notch or recess 73 that makes it possible, as will be seen in the remainder of the description, to push the tube.

The ring is also provided with two rectangular tabs 72 extending radially outwardly, the two tabs preferably being at diametrically opposed positions on the ring. In the mounted position of the head, each tab 72 is received in an indentation 61, 62 of the band.

Figure 5A:
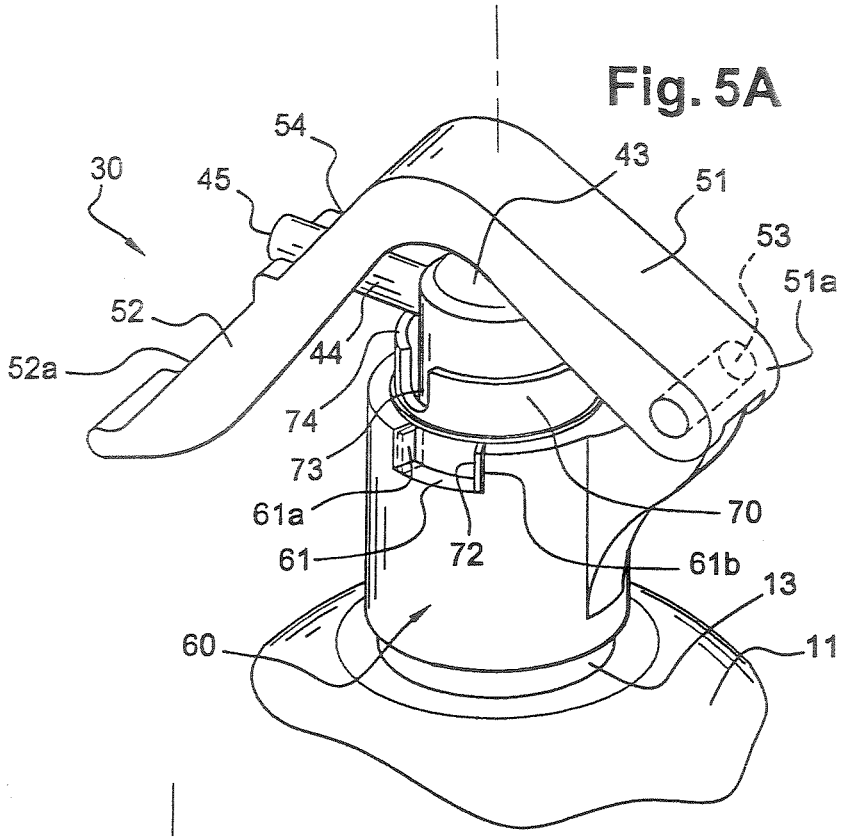
FIG. 5A shows the dispensing head in the locked position.
Figure 5B:
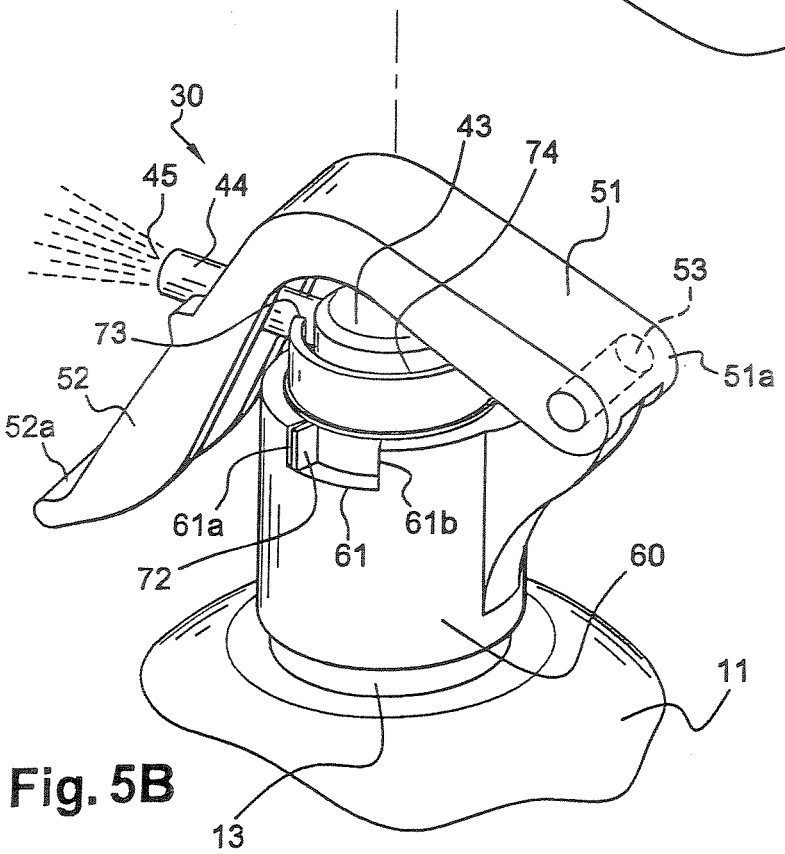
FIG. 5B shows the dispensing head during dispensing of the product.

The locking ring 70 is able to move from a first position, shown in FIG. 5A, in which the pump cannot be actuated, to a second position, shown in FIG. 5B, in which the pump can be actuated to dispense the product contained in the receptacle.

In the first position, i.e. the locked position, the tabs 72 abut, respectively, against one of the edges or portions 61*b*, 62*b* of the indentations or recesses 61 and 62. The notch 73 is not vertically aligned with the tube 44 in the locked position. The upper edge 74 of the ring is therefore opposite the tube. Thus, if an attempt is made to cause the lever arm to pivot, the tube 44 abuts against the upper edge 74 of the ring.

In order to move the locking member from the first position to the second position, the user seizes the tabs 72 and causes the ring 70 to rotate until the tabs 72 abut against the other edges or portions 61*a*, 62*a* of the indentations. In this second position, which corresponds to the use position, the notch 73 is vertically aligned with the tube 44 such that the trigger may be actuated in order to push the diffuser, with the tube being pushed into the notch 73.

After having actuated the pump, the user can then easily return the ring to the locked position by again displacing the tabs until they abut against the first edges 61*b* and 62*b* of the indentations.

The locked and actuation positions are thus easily identifiable to the user since they each correspond to an abutment position of the tabs against one of the edges or portions of the indentations or recesses.

By using two tabs 72 that are diametrically opposed on the ring, the user can seize the ring properly and is able to cause it to rotate easily. It is therefore possible to use tabs 72 that are not very big and do not extend very far beyond the mounting band 60. The overall size of the ring 70 is preferably limited, such that its presence does not interfere with the mounting of the head on the receptacle, for example by snap-fitting of the band over the receptacle's neck.

In the above detailed description, reference was made by way of non-limiting example to preferred embodiments of the invention. Obviously, numerous modifications and variations of the present invention are possible in light of the above teachings. It is therefore to be understood that within the scope of the appended claims, the invention may be practiced otherwise than as specifically described herein.

The invention claimed is:

1. A dispensing head for a receptacle, comprising:

a pump having an actuating rod with a longitudinal axis X;

a diffuser mounted on the pump, the diffuser including a tube opening at a dispensing orifice, the tube being elongated along an axis Y distinct from the axis X;

a lever arm that controls actuation of the pump, the lever arm including a portion that bears on the diffuser so as to push the diffuser in order to actuate the pump; and a locking member that can be positioned in a first position and in a second position;

wherein:

when the locking member is in the first position, the locking member allows actuation of the pump;

when the locking member is in the second position, the locking member prevents actuation of the pump; and the tube abuts against a portion of the locking member to prevent actuation of the pump when the locking member is in the second position.

2. The dispensing head according to claim 1, wherein:

the locking member comprises a ring at least partially surrounding the diffuser; and the ring comprises at least one upper edge against which the tube can abut when the locking member is in the second position.

3. The dispensing head according to claim 2, wherein the upper edge of the ring comprises a notch or recess that allows movement of the diffuser when the locking member is in the first position.

4. The dispensing head according to claim 3, wherein the tube is arranged above the ring and is vertically aligned with the notch or recess when the locking member is in the first position.

5. The dispensing head according to claim 1, wherein the lever arm comprises a window traversed by the tube.

6. The dispensing head according to claim 1, further comprising a mounting band capable of being mounted onto the receptacle.

7. The dispensing head according to claim 6, wherein the pump is mounted to the mounting band.

8. The dispensing head according to claim 6, wherein the lever arm is articulated on the mounting band.

9. The dispensing head according to claim 8, wherein the lever arm comprises a first end articulated on the mounting band, and a second end for controlling actuation of the pump.

10. The dispensing head according to claim 9, wherein the lever arm bears against the diffuser at a location between the first end and the second end of the lever arm.

11. The dispensing head according to claim 9, wherein the lever arm includes a first descending portion descending downwardly toward the first end and a second descending portion descending downwardly toward the second end.

12. The dispensing head according to claim 1, wherein:

the locking member comprises a ring at least partially surrounding the diffuser;

the ring comprises at least one upper edge against which the tube can abut when the locking member is in the second position; and the ring comprises at least one tab extending radially outwardly from a remainder of the ring.

13. The dispensing head according to claim 12, wherein the at least one tab is configured to be capable of abutting a first adjacent portion of the dispensing head when the locking member is in the first position and a second adjacent portion of the dispensing head when the locking member is in the second position.

14. The dispensing head according to claim 12, wherein the ring comprises two diametrically opposed tabs.

15. The dispensing head according to claim 1, wherein:

the locking member comprises a ring at least partially surrounding the diffuser;

the ring comprises at least one upper edge against which the tube can abut when the locking member is in the second position;

the ring comprises an outer surface; and the outer surface of the ring comprises a rib extending outwardly from a remainder of the ring.

16. The dispensing head according to claim 15, further comprising a mounting band capable of being mounted onto the receptacle, wherein:

the mounting band comprises an inner surface; and the inner surface of the mounting band comprises a groove extending into the mounting band relative to the inner surface.

17. The dispensing head according to claim 16, wherein:

the ring and the mounting band communicate such that the rib of the ring is fit into the groove of the mounting band; and the rib and the groove are configured such that the ring can rotate with respect to the mounting band.

18. The dispensing head according to claim 1, further comprising a mounting band capable of being mounted onto the receptacle, wherein:

the locking member comprises a ring at least partially surrounding the diffuser;

the ring comprises at least one upper edge against which the tube can abut when the locking member is in the second position;

the ring comprises at least one tab extending radially outwardly from a remainder of the ring;

the mounting band comprises a recess which receives the at least one tab;

the at least one tab abuts against a first side of the recess when the locking member is in the first position; and the at least one tab abuts against a second side of the recess when the locking member is in the second position.

19. A dispensing head for a receptacle, comprising:

a pump having an actuating rod with a longitudinal axis X;

a diffuser mounted on the pump, the diffuser including a tube opening at a dispensing orifice, the tube being elongated along an axis Y distinct from the axis X;

a lever arm that controls actuation of the pump, the lever arm including a portion that bears on the diffuser so as to push the diffuser in order to actuate the pump;

a locking member that can be positioned in a first position and in a second position; and a mounting band capable of being mounted onto the receptacle;

wherein:

the locking member comprises a ring that at least partially surrounds the diffuser, the ring comprising an upper edge having a notch or recess;

the tube is vertically aligned with the notch or recess when the locking member is in the first position, allowing movement of the diffuser to actuate the pump; and the tube abuts against the upper edge of the ring in a location away from the notch or recess when the locking member is in the second position, preventing movement of the diffuser to actuate the pump.

20. A dispensing head for dispensing a liquid from a container, comprising:

a substantially cylindrical mounting band comprising an inner surface, the inner surface comprising a threaded portion for screwed attachment to the container and a groove extending into the inner surface;

a pump attached to the mounting band, the pump including an actuating rod for actuating the pump;

a diffuser comprising a vertical portion configured to contact and actuate the actuating rod of the pump when the diffuser is depressed, and a tube portion that includes a spray orifice and extends horizontally outwardly from the vertical portion;

a lever arm having a first end attached to the mounting band, a second end that operates as a trigger, and a bearing surface between the first end and the second end that depresses the diffuser when the second end is operated as a trigger; and a substantially cylindrical locking member rotatably mounted to the mounting band and configured to at least partially surround the vertical portion of the diffuser, the locking member having an outer surface including a rib and an upper edge including a recessed portion and an unrecessed portion;

wherein:

the rib on the outer surface of the locking member fits into the groove on the inner surface of the mounting band so as to permit rotation of the locking member with respect to the mounting band;

the locking member can be rotated from an unlocked position, in which the recessed portion of the upper edge of the locking member is situated beneath the tube portion of the diffuser, to a locked position, in which the unrecessed portion of the upper edge of the locking member is situated beneath the tube portion of the diffuser;

when the locking member is in the locked position, depressing the diffuser causes the tube portion of the diffuser to abut the unrecessed portion of the upper edge of the locking member, preventing actuation of the pump to dispense the liquid; and the lever arm comprises a first descending portion descending downwardly toward the first end and a second descending portion descending downwardly toward the second end, the second descending portion comprising a window traversed by the tube portion of the diffuser.

* * * * *